US007213902B2

(12) United States Patent
DeVivo et al.

(10) Patent No.: US 7,213,902 B2
(45) Date of Patent: May 8, 2007

(54) METHOD OF SHUTTING DOWN A CONTINUOUS INK JET PRINTER FOR MAINTAINING POSITIVE PRESSURE AT THE PRINTHEAD

(75) Inventors: Daniel J. DeVivo, Dayton, OH (US); Robert J. Simon, Bellbrook, OH (US)

(73) Assignee: Eastman Kodak Company, Rochester, NY (US)

( * ) Notice: Subject to any disclaimer, the term of this patent is extended or adjusted under 35 U.S.C. 154(b) by 284 days.

(21) Appl. No.: 10/839,467

(22) Filed: May 5, 2004

(65) Prior Publication Data

US 2005/0248608 A1 Nov. 10, 2005

(51) Int. Cl.
*B41J 2/165* (2006.01)

(52) U.S. Cl. ..... 347/28; 347/22

(58) Field of Classification Search ..... 347/28, 347/22

See application file for complete search history.

(56) References Cited

U.S. PATENT DOCUMENTS

| | | | | | |
|---|---|---|---|---|---|
| 3,891,121 | A * | 6/1975 | Stoneburner | 222/1 |
| 4,314,264 | A * | 2/1982 | Bok et al. | 347/89 |
| 4,318,114 | A * | 3/1982 | Huliba | 347/89 |
| 5,126,752 | A * | 6/1992 | Weinberg | 347/28 |
| 5,463,415 | A | 10/1995 | McCann et al. | |
| 5,793,389 | A * | 8/1998 | Mitchell | 347/28 |
| 5,923,347 | A * | 7/1999 | Wade | 347/28 |
| 6,145,954 | A * | 11/2000 | Moore | 347/28 |
| 6,273,103 | B1 | 8/2001 | Enz et al. | |
| 6,352,339 | B1 | 3/2002 | Loyd | |
| 6,679,590 | B2 | 1/2004 | Enz | |
| 6,869,160 | B2 * | 3/2005 | West et al. | 347/28 |
| 6,890,054 | B2 * | 5/2005 | West | 347/28 |
| 2004/0066427 | A1 * | 4/2004 | West et al. | 347/22 |

FOREIGN PATENT DOCUMENTS

| | | |
|---|---|---|
| EP | 1 013 437 | 6/2000 |
| EP | 1 070 592 | 7/2000 |
| EP | 1 405 728 | 4/2004 |
| WO | WO 93/17867 | 9/1993 |

* cited by examiner

*Primary Examiner*—Stephen Meier
*Assistant Examiner*—Rene Garcia, Jr.
(74) *Attorney, Agent, or Firm*—The Buskop Law Group, P.C.

(57) ABSTRACT

The method for shutting down an ink jet printhead and an ink jet printing station, wherein the method includes maintaining a constant positive pressure at the drop generator by closing the cross flush valve or ensuring that the cross flush valve is closed, thereby closing off the fluid return line to create a constant positive pressure through the drop generator and the orifice into the fluid line. The shutdown continues by stopping the flow of fluid from the fluid supply line and circulating cleaning fluid through at least one filter, into the drop generator, out through the orifice structure, into the fluid line, and into a reservoir. The shutdown ends by flowing pressurized air, which is preferably clean of particulates, through the filter, drop generator, orifice structure, and fluid line to displace substantially all the cleaning fluid from the filter, drop generator, and orifice structure.

14 Claims, 2 Drawing Sheets

METHOD OF SHUTTING DOWN A CONTINUOUS INK JET PRINTER FOR MAINTAINING POSITIVE PRESSURE AT THE PRINTHEAD

FIELD OF THE INVENTION

The present embodiments relate to continuous ink jet printers and more particularly, to a shutdown method associated with such printers.

BACKGROUND OF THE INVENTION

Current ink jet printing systems consist of a fluid system supporting one or more printheads. Typical ink jet printheads operate by forcing fluid through a droplet generator that contains an array of orifices, forming droplets of ink. The printhead is fully supported by the fluid system. The fluid system controls different valves and pumps to perform necessary functions for the printhead to operate reliably. These functions include cleaning, startup, and shutdown. One particular function, shutdown, provides a means to stop the operation of the printhead and fluid system over an extended period of time and, allows for a restart of the operation. If ink or cleaning fluid is left in the droplet generator, the fluids can dry in and around the orifices leaving behind non-volatile components in the form of solids or gels. Upon subsequent startups, the failure to remove or re-dissolve all of this material in and around the orifices creates disturbances in the shape or direction of the emerging jets.

McCann U.S. Pat. No. 5,463,415 describes one operation of shutting down a printhead of an ink jet printing system. Shutdown consists of applying a high vacuum to the outlet of a droplet generator with the inlet open to the atmosphere through a filtered restriction. Air is drawn into the droplet generator through a filtered restriction, and through the droplet generator orifices, to remove the ink from the interior of the droplet generator. Problems arise with the method in the McCann reference when air flow rates are insufficient to remove significant amounts of ink from the droplet generator of very large arrays of jets.

Enz U.S. Pat. No. 6,679,590 teaches pulsing air flow to dry the printhead.

Loyd U.S. Pat. No. 6,352,339 teaches a vacuum system which is used to clean ink jet printers. The prior art described herein are incorporated by reference.

A need exists for a shutdown procedure that effectively removes ink from the drop generator and orifice structure without causing particles to be deposited around the orifices and without using a vacuum or pulsed system.

SUMMARY OF THE INVENTION

The ink jet printing station has a drop generator with an inlet and outlet, an orifice structure, a plurality of jets, at least one filter in a fluid supply line connected to an ink supply with an fluid supply pump connected to the drop generator, a fluid line for receiving fluid from the plurality of jets, a fluid return line connected to the outlet, a cross flush valve in the fluid return line, and a reservoir for receiving fluid from the fluid line. The printing station uses a cleaning fluid source connected to the at least one filter, the drop generator, and the orifice structure. The cleaning fluid source ensures a constant positive pressure ranging between 0.1 psi and 35 psi at the drop generator. A pressurized air source is used to displace fluid from the one or more of the filters, the drop generator, the orifice structure, and the fluid line. The pressurized air source maintains a constant positive pressure to the drop generator, and displaces fluid from the drop generator.

The method for shutting down an ink jet printhead of an ink jet printing station entails maintaining a constant positive pressure ranging between 0.1 psi and 35 psi at the drop generator to shut down the ink jet printhead. The constant positive pressure is maintained by ensuring the cross flush valve closes the fluid return line connected to the outlet to create the constant positive pressure on the filter and drop generator, and causing fluid to flow out of the orifice structure into the fluid line. The pressure is further maintained by stopping the flow of fluid from the fluid supply line; circulating cleaning fluid from a cleaning fluid source through one or more of the filters into the drop generator, out through the orifice structure into the fluid line, and into the reservoir; and flowing clean pressurized air through the at least one filter, the drop generator, the orifice structure, and the fluid line. The cleaning fluid displaces substantially all the cleaning fluid from the filters, the drop generator, and the orifice structure.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways The ink jet printing station and method removes ink from an ink jet printhead for shutdown purposes without causing air, which may contain dirt, to be ingested into the ink jet orifice structure.

Debris on the orifice structure is a primary source of malfunction in ink jet printing systems. The method of the invention reduces malfunctions and complete printhead failures in the field caused by the debris. The method increases start up reliability dramatically, up to 10% better than conventional techniques, by shutting down a clean printhead.

The method and resulting equipment are faster and less expensive than those in the known art because less cleaning fluid is required for shut down and for subsequent start up The use of less cleaning fluid has an added environmental benefit. Since the cleaning fluid is used only at the orifice structure, less fluid is needed to clean, and fewer fumes are generated if the cleaning fluid is a volatile fluid. In addition, a smaller amount of toxic chemicals need to be disposed of at the end of the shutdown process.

Also, less time is needed to clean the orifice structure, thereby saving the user both time and money.

With the use of ever smaller orifices and a larger quantity of orifices in a printhead, higher quality cleaning is needed. The invention meets these needs.

The method provides a system that prevents bubble formation in the orifice structure. The method successfully prevents excessive splatter.

Figure 1:
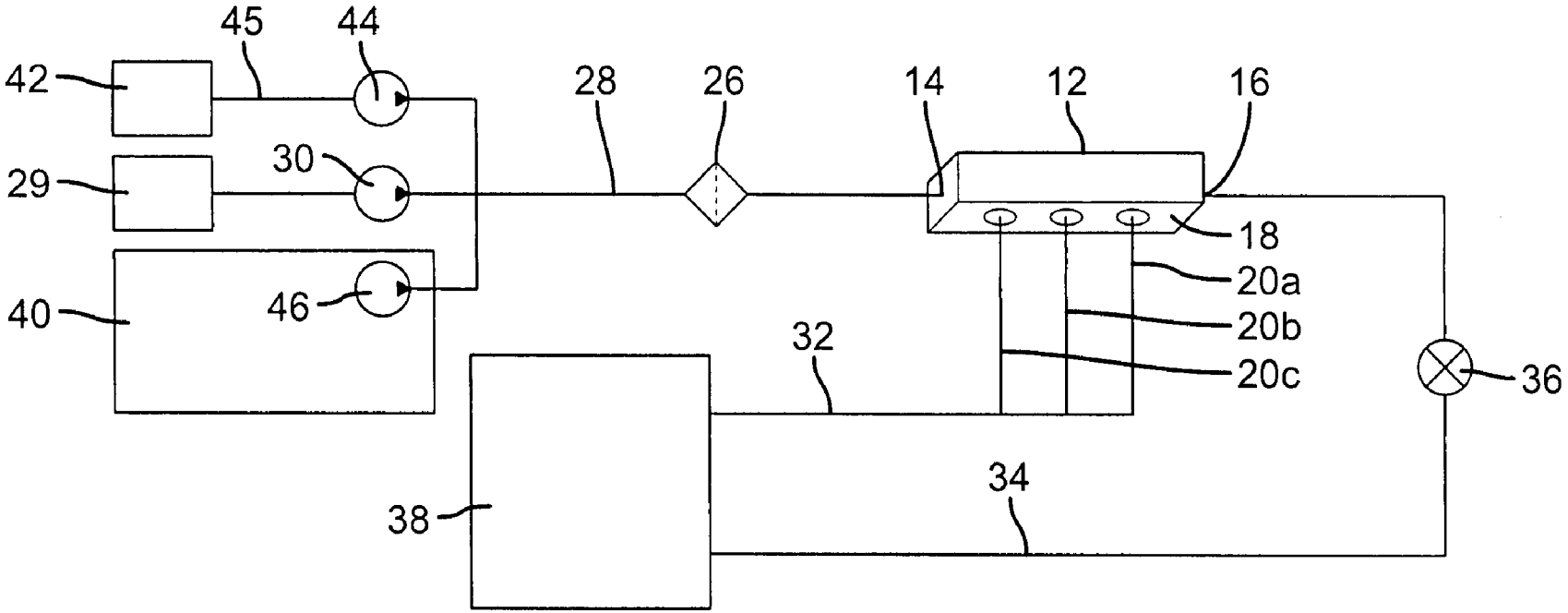
FIG. 1 is a schematic block diagram of the system.

With reference to the figures, FIG. 1 depicts a diagram of print stations with this unique shutdown equipment.

A printhead with a drop generator 12 has an orifice structure 18 with a plurality of orifices that form jets 20*a*, 20*b*, and 20*c*. Fluid from the plurality of jets 20*a*, 20*b*, and 20*c* flows into a fluid line 32. The fluid line 32 leads to a reservoir 38 which can contain ink, cleaning fluid, and/or debris.

Fluid flows from the outlet 16 of the drop generator. The fluid return line 34 has a cross flush valve 36 to pass fluid, such as ink or cleaning fluid, from the drop generator 12 to a reservoir 38. Fluid is introduced to the drop generator 12 through an inlet 14 from an ink supply 29 or a cleaning fluid source 42. Cleaning fluid from the cleaning fluid source 42 is pumped using a cleaning fluid supply pump 44. The cleaning fluid flows through the cleaning fluid line 45 into the cleaning fluid supply pump 44 then into the drop generator 12 through the fluid supply line 28.

Ink from the ink supply 29 is pumped using the ink pump 30 through the fluid supply line to the drop generator 12. A pressurized air source 40 supplies pressurized air to the fluid supply line 28. In one preferred embodiment, the pressurized air source 40 comprises an air pump 46 to pump air under pressure into the fluid supply line 28. In another embodiment, the pressurized air source comprises a pressured gas cylinder or tank. The pressurized air then flows to the drop generator 12. At least one filter 26 is disposed in the fluid supply line 28 between drop generator 12 and each of the pressurized air source 40, the ink supply 29, and the cleaning fluid source 42.

Figure 2:
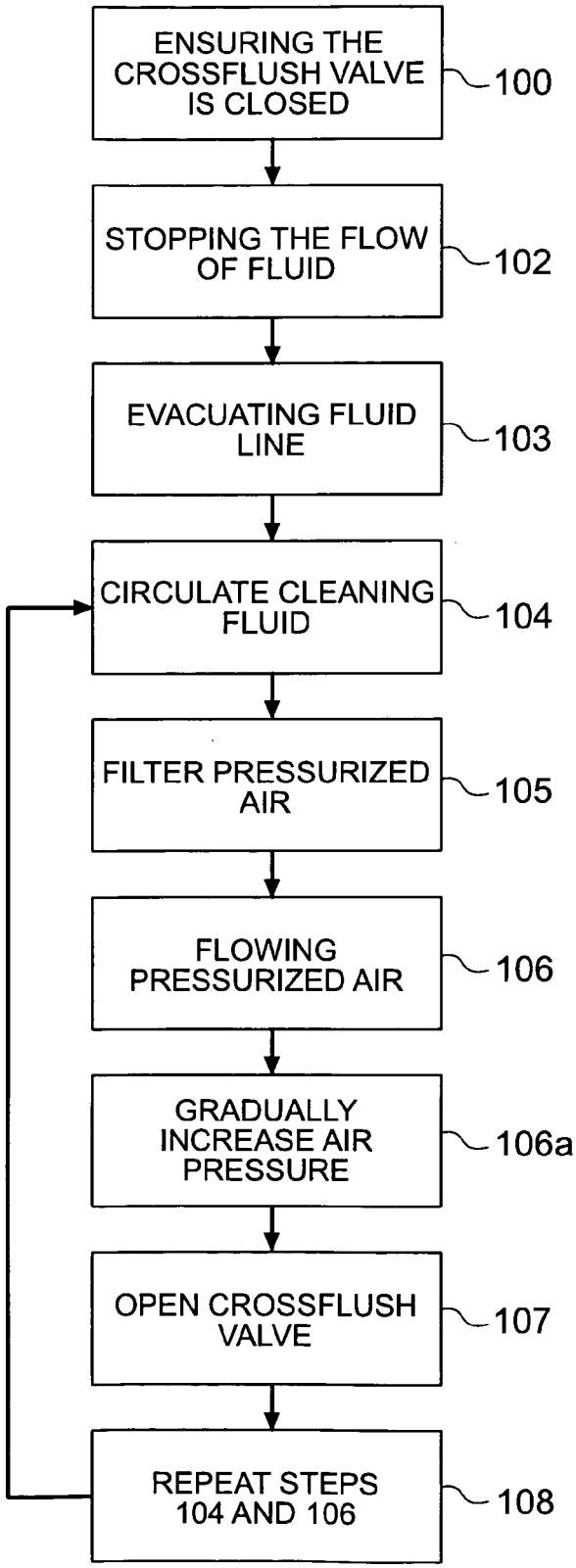
FIG. 2 is a flow chart diagram illustrating the method of shutting down an ink jet printhead of a continuous ink jet printing station.

FIG. 2 is a flow chart diagram illustrating the method of shutting down an ink jet printhead of a continuous ink jet printing station. The shutdown procedure starts by ensuring the cross flush valve is closed, or if it is open, closing the cross flush valve, thereby closing the fluid return line (Step 100).

Closing the cross flush valve forces positive pressure to flow through a filter, through a drop generator, out the orifices to a fluid line, and to a reservoir.

The method continues by stopping the flow of fluid from the fluid supply line (Step 102). The fluid flow can be stopped by turning off the fluid supply pump.

The cleaning fluid is circulated from a cleaning fluid source through at least one filter to the drop generator (Step 104). After the drop generator, the cleaning fluid flows out of the orifice structure, into the fluid line, and into a reservoir. The cleaning fluid source can be pressurized but does not have to be pressurized. The pumping of the cleaning fluid source insures that positive pressure is on the drop generator. The cleaning fluid can be circulated using a cleaning fluid supply pump 44, as depicted in FIG. 1.

The method ends by flowing pressurized air through the at least one filter, the drop generator, the orifice structure, and the fluid line (Step 106). Preferably, the pressurized air is cleaned before flowing using a filtration step (Step 105).

The pressurized air displaces substantially all the cleaning fluid from the at least one filter, the drop generator, and the orifice structure. The pressurized air is initially at a low pressure, in the range of 0.1 psi to 3 psi, and then gradually increased over time (Step 106*a*).

By initially supplying the pressurized air at a low pressure before increasing the air pressure, the air can displace the cleaning fluid from the drop generator and orifice structure with minimal bubbling and splattering. The pressurized air is preferably formed by filtering pressurized air prior to flowing air into the filter.

The steps of circulating the cleaning fluid and flowing the clean pressurized air can be repeated until the system is thoroughly cleaned (Step 108).

By repeating the steps of circulating the cleaning fluid and flowing the pressurized air through the system, ink residues are more effectively removed from the drop generator than by extending the times of circulating the cleaning fluid and flowing the pressurized air through the system.

Another embodiment of the method can further comprise the step of evacuating the fluid line prior to circulating the cleaning fluid (Step 103).

The method can further comprise opening the cross flush valve after flowing the pressurized air through the printing station (Step 107).

The system is controlled by a microprocessor that connects to the pumps, valves, air source and fluid source, to ensure sequential delivery of the air, ink, and cleaning fluid so as to clean out the drop generator during shutdown procedures.

In a preferred embodiment, the printhead can be a Kodak Versamark DH92 available from Kodak Versamark of Dayton, Ohio.

A typical usable ink jet printing system can use an orifice structure of between 1000 orifices and 3000 orifices, preferably 2700 orifices or, optionally 300 orifices per inch orifice arrays.

Preferred inks used in the system are a water based ink, a solvent based ink, a pigment ink, dye based inks, a polymer ink, and combinations thereof.

An example of a preferred cleaning fluid is an ink compatible fluid. This type of cleaning fluid is commercially available as Versamark FF1035 cleaning fluid available from Kodak Versamark. The cleaning fluids can contain surfactants for certain types of inks, have high pH for certain types of inks, and be water based for water based inks.

The pressurized air source preferably exerts a constant, non-pulsing, pressure between 0.1 psi and 50 psi at the drop generator. For a printhead using 2700 orifices, the preferred pressure at the drop generator is between 20 and 25 psi.

The pressurized air must be "clean", or without the presence of particulates. It is preferred that the particulates which have a diameter not larger than 0.2 microns be filtered. It is also preferred to have a filter which can remove liquids, oils, water, condensate, and other contaminates.

To ensure the quality of the pressurized air, air can be passed through a filter either before the air is placed into the air supply or as the air is pumped into the fluid supply line 28. The pressurized air is initially at a low pressure, in the range of 0.1 psi to 3.0 psi. The pressure is then gradually raised over time to reach an optimum operating pressure at the drop generator.

The cleaning fluid supply can be pressurized as well to ensure positive pressure on the overall fluid lines and drop generator in order to further assist in cleaning the ink from the orifices and orifice structure.

The embodied methods and systems can be adapted for use with a two filter ink jet system comprising a dual feed supply line.

The embodiments have been described in detail with particular reference to certain preferred embodiments thereof, but it will be understood that variations and modifications can be effected within the scope of the embodiments, especially to those skilled in the art.

PARTS LIST

12. drop generator
14. inlet
16. outlet
18. orifice structure
20*a*. jet
20*b*. jet
20*c*. jet
26. filter
28. fluid supply line
29. ink supply
30. fluid supply pump
32. fluid line
34. fluid return line
36. cross flush valve
38. reservoir
40. pressurized air source
42. cleaning fluid source
44. cleaning fluid supply pump
45. cleaning fluid line
46. air supply pump
100. step—ensuring the cross flush valve is closed
102. step—stopping the flow of fluid
103. step—evacuating the fluid line
104. step—circulating cleaning fluid
105. step—filtering pressurized air
106. step—flowing pressurized air through the at least one filter, the drop generator, the orifice structure, and the fluid line
106*a*. step—gradually increasing air pressure
107. step—opening the cross flush valve
108. step—repeating steps 104 and 106

What is claimed is:

1. A method for shutting down an ink jet printhead of a ink jet printing station, wherein the ink jet printing station comprises a drop generator with an inlet and outlet, an orifice structure, a plurality of jets, at least one filter in a fluid supply line, a fluid supply pump connected to the drop generator, a fluid line, a fluid return line with a cross flush valve, a reservoir, and a source of pressurized air and a cleaning fluid source, wherein the method comprises the steps of:

a. maintaining a constant positive pressure at the drop generator to shut down the ink jet printhead, wherein the constant positive pressure ranges between 0.1 psi and 35 psi, and wherein the constant positive pressure is maintained by the steps of i. ensuring the cross flush valve closes the fluid return line connected to the outlet to create the constant positive pressure on the filter and the drop generator causing fluid to flow out of the orifice structure into the fluid line;

ii. stopping the flow of fluid from the fluid supply line;

b. circulating cleaning fluid from a cleaning fluid source through at least one filter, into the drop generator, out through the orifice structure, into the fluid line, and into the reservoir; and c. flowing clean pressurized air through the at least one filter, the drop generator, the orifice structure, and the fluid line to displace substantially all the cleaning fluid from the at least one filter, drop generator, and orifice structure;

d. evacuating the fluid line prior to step of circulating cleaning fluid.

2. A method for shutting down an ink jet printhead of a ink jet printing station, wherein the ink jet printing station comprises a drop generator with an inlet and outlet, an orifice structure, a plurality of jets, at least one filter in a fluid supply line, a fluid supply pump connected to the drop generator, a fluid line, a fluid return line with a cross flush valve, a reservoir, and a source of pressurized air and a cleaning fluid source, wherein the method comprises the steps of:

a. maintaining a constant positive pressure at the drop generator to shut down the ink jet printhead, wherein the constant positive pressure ranges between 0.1 psi and 35 psi, and wherein the constant positive pressure is maintained by the steps of i. ensuring the cross flush valve closes the fluid return line connected to the outlet to create the constant positive pressure on the filter and the drop generator causing fluid to flow out of the orifice structure into the fluid line;

ii. stopping the flow of fluid from the fluid supply line;

b. circulating cleaning fluid from a cleaning fluid source through at least one filter, into the drop generator, out through the orifice structure, into the fluid line, and into the reservoir;

c. flowing clean pressurized air through the at least one filter, the drop generator, the orifice structure, and the fluid line to displace substantially all the cleaning fluid from the at least one filter, drop generator, and orifice structure; and wherein the clean pressurized air is formed by filtering pressurized air prior to flowing into the filter.

3. The method of claim 2, wherein the constant positive pressure maintained on the drop generator is a low pressure ranging between 0.1 psi and 3 psi.

4. The method of claim 2, wherein the method is adapted for use with a two filter ink jet system comprising a dual feed supply line.

5. The method of claim 2, wherein the ink jet printing station is a continuous ink jet printing station.

6. The method of claim 2, wherein the fluid is a water-based ink, solvent-based ink, a pigment ink, a polymer ink, and combinations thereof.

7. The method of claim 2, wherein the step of circulating cleaning fluid through the printhead is performed using a cleaning fluid supply pump.

8. The method of claim 2, wherein the cleaning fluid source is pressurized.

9. The method of claim 2, wherein the step of stopping of the flow of fluid from the fluid supply line is performed by turning off the fluid supply pump.

10. The method of claim 2, wherein a step of flowing clean pressurized air is performed using a low pressure for the clean pressurized air, wherein the low pressure ranges between 0.1 psi to 3 psi, and wherein the pressure from the source of pressurized air is gradually increased.

11. The method of claim 2, further comprising the step of opening the cross flush valve after the step of flowing clean pressurized air into the printhead.

12. The method of claim 2, further comprising the step of repeating the steps of circulating cleaning fluid and of flowing clean pressurized air.

13. The method of claim 2, wherein the cleaning fluid is an ink-compatible liquid.

14. The method of claim 2, wherein the cleaning fluid is without color.

* * * * *